US011259654B1

(12) United States Patent
Padula

(10) Patent No.: US 11,259,654 B1
(45) Date of Patent: Mar. 1, 2022

(54) ARTICLE SUPPORT APPARATUS

(71) Applicant: Desiree Coleen Padula, Denver, CO (US)

(72) Inventor: Desiree Coleen Padula, Denver, CO (US)

( * ) Notice: Subject to any disclaimer, the term of this patent is extended or adjusted under 35 U.S.C. 154(b) by 0 days.

(21) Appl. No.: 17/352,335

(22) Filed: Jun. 20, 2021

Related U.S. Application Data

(60) Provisional application No. 63/093,265, filed on Oct. 18, 2020.

(51) Int. Cl.
*A47F 5/08* (2006.01)
*A47F 7/02* (2006.01)

(52) U.S. Cl.
CPC ..... *A47F 5/0815* (2013.01); *A47F 5/0838* (2013.01); *A47F 5/0884* (2013.01); *A47F 7/02* (2013.01)

(58) Field of Classification Search
CPC ..... A47F 5/0815; A47F 5/0838; A47F 7/02; A47F 7/022; A47F 7/005; A47F 7/12; A47F 5/08; A47F 5/0876; A47F 5/0884
USPC ..... 211/85.2, 61, 87.01, 94.01, 85.9, 113; 206/6.1
See application file for complete search history.

(56) References Cited

U.S. PATENT DOCUMENTS 3,421,634 A * 1/1969 Margaret ..... A47F 7/02 211/123
3,497,074 A * 2/1970 Shaheen ..... A47G 29/10 211/85.9
3,997,219 A * 12/1976 Phelps ..... A47F 7/02 312/234
4,264,013 A * 4/1981 Vollmer ..... A47G 29/08 211/85.2
4,322,007 A * 3/1982 Feibelman ..... A47F 7/02 211/163
D291,641 S * 9/1987 Farley ..... D6/566
4,746,009 A * 5/1988 Liberman ..... G09F 5/02 190/16
D304,793 S * 11/1989 Burke ..... D6/569
D319,749 S * 9/1991 McPherson ..... D6/571
5,067,617 A * 11/1991 Caldwell ..... A47F 5/0807 211/85.2
5,117,971 A * 6/1992 Fisher ..... A47F 7/03 206/486
D328,681 S * 8/1992 Radosevich ..... D6/567
D332,025 S * 12/1992 Caldwell ..... D6/570
(Continued)

*Primary Examiner* — Jennifer E. Novosad
(74) *Attorney, Agent, or Firm* — Roger A. Jackson

(57) ABSTRACT

An article support apparatus to support a plurality of different articles in a non-engageable manner, the apparatus includes a beam having a first and second end portions, plus primary and secondary margins, also first and second sides, the beam further including an open straight slot disposed partially into the beam, the beam also has a "J" hook slot oppositely disposed partially into the beam. Further included in the article support apparatus is a support frame affixed to both the beam first and second end portions, wherein the support frame suspends the beam in a horizontal manner to facilitate operationally the open straight slot holding an article with a flange ended straight cylinder resting in the open straight slot without the need for removing the flange ends and the "J" hook slot holding an article with a continuous loop section without the need of opening the article continuous loop section.

11 Claims, 17 Drawing Sheets

(56) References Cited

U.S. PATENT DOCUMENTS

| | | | | | |
|---|---|---|---|---|---|
| D338,127 | S | * | 8/1993 | Bass | D6/570 |
| 5,242,048 | A | * | 9/1993 | Ellingsworth | A47F 7/02 206/495 |
| 5,511,873 | A | * | 4/1996 | Mech | A45C 11/16 206/566 |
| D372,380 | S | * | 8/1996 | Montalbo | D6/682.4 |
| D428,533 | S | * | 7/2000 | Carroll | D28/73 |
| 6,158,578 | A | * | 12/2000 | Greiner | A47F 5/10 206/6.1 |
| 6,199,705 | B1 | * | 3/2001 | Portner | A47F 5/0846 211/26 |
| 6,375,018 | B1 | * | 4/2002 | Clement | A47F 7/02 211/85.2 |
| 6,422,383 | B1 | * | 7/2002 | LaMarca | A47F 7/03 206/6.1 |
| 6,422,384 | B1 | * | 7/2002 | Roederer | A45C 11/16 206/566 |
| 6,945,414 | B1 | * | 9/2005 | Stevens | A47F 5/0846 211/183 |
| 7,147,291 | B1 | * | 12/2006 | Greiner | A47B 67/00 312/294 |
| 7,182,416 | B1 | * | 2/2007 | Greiner | A45C 11/16 206/6.1 |
| 8,800,789 | B2 | * | 8/2014 | Sharp | A47F 7/02 211/85.2 |
| D769,025 | S | * | 10/2016 | Eberling | D6/569 |
| D789,707 | S | * | 6/2017 | Porisky | D6/569 |
| 10,092,116 | B1 | * | 10/2018 | Johns | A47F 7/022 |
| D928,528 | S | * | 8/2021 | Liu | D6/514 |

* cited by examiner

ARTICLE SUPPORT APPARATUS

RELATED APPLICATION

This application claims the benefit of U.S. provisional patent application Ser. No. 63/093,265 filed on Oct. 18, 2020 by Desiree Coleen Padula of Denver, Colo., U.S.

TECHNICAL FIELD

The present invention generally relates to an article support apparatus used typically to display articles. More particularly, the present invention is an article support apparatus for displaying and storing articles of jewelry, wherein the article display apparatus can be wall, table, or door mounted.

BACKGROUND OF INVENTION

Typical jewelry storage boxes tend to bunch up the various items of jewelry into an entangled pile of knotted chains, hooks, clasps, and so on, that make it very difficult to select or pick out a particular item of jewelry due to lack of single jewelry item visibility, and further if the single item is selected, then there is the annoying job of untangling the selected item of jewelry from the entangled pile of other jewelry. Further the typical jewelry box merely separates jewelry items via small boxed off compartments, however, within those small compartments the jewelry items can bang around during jewelry storage box moving and storage that tends to cause the aforementioned entanglement, which is acerbated by the many variable shapes and sizes of various items of jewelry.

Looking at the prior art in U.S. Pat. No. 6,375,018 to Clement, disclosed is a jewelry support rack that includes a plurality of plastic strips that are disposed in a parallel alignment to one another, wherein the plastic strips are supported by a pair of posts that support the plastic strips horizontally that can be selectively unevenly spaced vertically to accommodate different size jewelry due to a friction grip support in the support posts. The plastic strips have vertical slots partially disposed within the plastic strips with the slots open to the top of the plastic strips, that can accommodate jewelry with a fixed post section from the top, however, the open top vertical slot is limited in that they cannot accommodate hoop type jewelry without opening the hoop to put the hoop jewelry in the plastic strip slot and the same would have to be done to remove the hoop type jewelry from the plastic strip via disconnecting the hoop portion of the jewelry. The posts and the plastic strips are enclosed within an enclosure cabinet that has a door to provide concealment and to protect the jewelry from the elements.

There remains a need for a jewelry display and storage apparatus that allows for easy placement and removal of the jewelry without the need for taking apart or putting together; clasps, clamps, hooks, retainers, and so on, further it is desirable that the jewelry is easy to instantly see, i.e. all jewelry items are independently displayed simultaneously, for an individual to be able to select their desired item of jewelry quickly and easily, this required desirably that each individual item of jewelry be individually displayed to not become tangled with other jewelry items, to be easy to see and select, and finally easy to remove the jewelry item and replacement it in the display and storage apparatus. A further desirable feature of the jewelry display and storage apparatus would be the ability to accommodate different sizes and shapes of jewelry in the same jewelry display and storage apparatus, so there would be supports for the different items of jewelry with different spacing to accomplish this.

SUMMARY OF INVENTION

Broadly, the present invention is an article support apparatus adapted to support a plurality of different articles in a non-engageable manner, the article support apparatus includes a beam having a longitudinal axis, the beam having a first end portion and an opposing second end portion with the longitudinal axis spanning therebetween, the beam further having a vertical axis that is perpendicular to the longitudinal axis. The beam having a primary margin and an opposing secondary margin with the vertical axis spanning therebetween, the beam also having a lateral axis perpendicularly positioned to both the longitudinal and vertical axes, with the beam having a first side and an opposing second side with the lateral axis spanning therebetween. The beam further including an open straight slot disposed partially into the beam in going from the secondary margin and partially proceeding toward the primary margin being therethrough from the first side to the second side, the beam also has a "J" hook slot disposed partially into the beam in going from the primary margin and partially proceeding toward the secondary margin being therethrough from the first side to the second side.

Further included in the article support apparatus a support frame affixed to both the beam first and second end portions, wherein the support frame suspends the beam such that the longitudinal axis is laterally positioned to facilitate operationally the open straight slot holding an article with a flange ended straight cylinder resting in the open straight slot without the need for removing the flange ends and the "J" hook slot holding an article with a continuous loop section without the need of opening the article continuous loop section.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 2 is cross sectional view 2-2 from FIG. 11, wherein FIG. 2 shows the fit-up intersection between the beam, the support frame, and the larger perimeter structure;

FIG. 4 shows view 4-4 from FIG. 3, wherein FIG. 4 shows the side elevation view of the support frame;

FIG. 5 shows view 5-5 from FIG. 3, wherein FIG. 5 shows the upper elevation view of the support frame;

FIG. 17 shows an expanded view of the "J" hook slot that is disposed in the beam as shown from FIG. 11, wherein FIG. 17 shows the open ended slot with the neck portion and expanded portion wherein the neck portion of the open ended slot can assume a short or long length and be straight, curved or angled as long as the article with the continuous loop section can be passed through the neck portion, further the expanded portion of the open ended slot can assume any shape with the requirement of acting as a repository of the article with the continuous hoop section to not slide out of the neck portion, further both the neck portion and the expanded portion are adjacent to the primary margin such that the article continuous hoop section can be disposed about the neck portion, the expanded portion, and the primary margin to facilitate the continuous hoop section article to be disposed within the slot expanded portion and removed from the slot without the need for opening the continuous hoop section of the article, further for the continuous hoop article to be laterally retained while disposed in the slot expanded portion.

REFERENCE NUMBERS IN DRAWINGS

Figure 1:
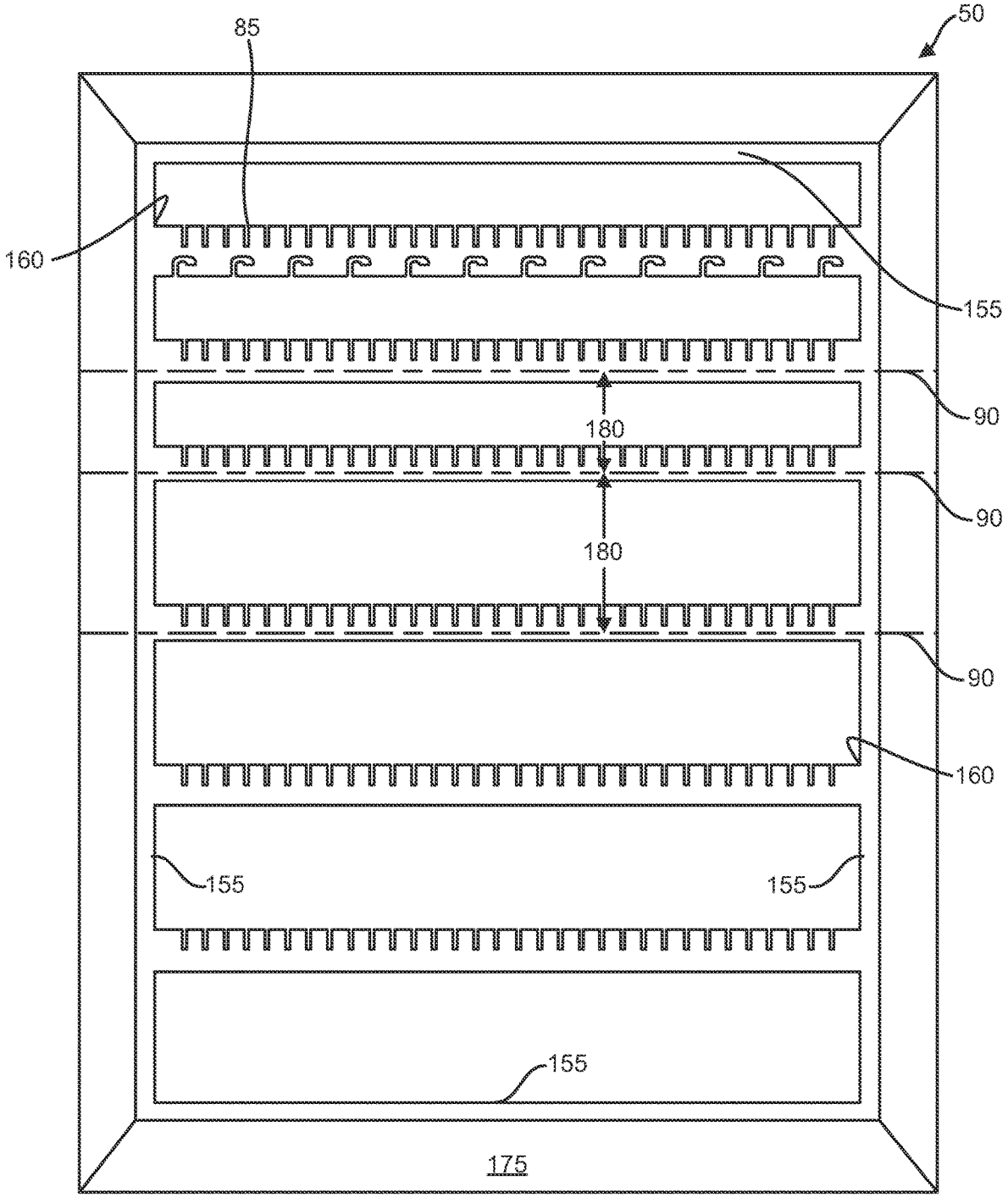
FIG. 1 shows a front elevation view of the article support apparatus that includes a plurality of beams, a support frame, a large perimeter structure, and a different spacing of the beams apart from one another for different size articles (articles not shown for clarity)

50 Article support apparatus
55 Plurality of different articles
60 Flange end of the article 55 which can be an earring post retainer and a decorative jewelry item, both of which are disposed on opposite ends the straight cylinder 65
65 Straight cylinder of the article 55 which can be an earring post
70 Resting position of the straight cylinder 65 of the article 55 in the open straight slot 120
75 Continuous loop section of the article 55 which can be an earring hoop that has a detachable/re-attachable section that can open and subsequently close the hoop
80 Holding position of the continuous loop section 75 of the article in the "J" hook slot 150 or the neck portion 148 and the expanded portion 149 of the slot 147
85 Beam
90 Longitudinal axis of the beam 85
95 First end portion of the beam 85
100 Second end portion of the beam 85
105 Vertical axis of the beam 85
110 Perpendicular position of the vertical axis 105 and the longitudinal axis 90
115 Primary margin of the beam 85
120 Secondary margin of the beam 85
125 Lateral axis of the beam 85
130 Perpendicular position of the lateral axis 125 to both the longitudinal 90 and vertical
105 axes
135 First side of the beam 85
140 Second side of the beam 85
145 Open straight slot of the beam 85
147 Slot with neck portion 148 and expanded portion 149 of the beam 85
148 Neck portion of the slot 147 of the beam 85
149 Expanded portion of the slot 147 of the beam 85
150 "J" hook slot of the beam 85
151 Length portion of the neck 148
152 Adjacent distance
153 Margin border of the neck portion 148
154 Termination of the expanded section 149
155 Support frame

156 Lateral retention of the article 55 hoop section 75
157 Open end of slot 147, 150
158 Width of beam 85
159 Width of slot open end 157
160 Affixed portion of the support frame 155 to the beam 85 first 95 and second 100 end portions
161 Length of expanded portion 149
165 "U" slot of the support frame 155
170 Disposing of the beam 85 first 95 and second 100 end portions into the "U" slot 165 of the support frame 155
175 Larger perimeter structure which can be a picture type frame
180 Different spacing of the beam 85 longitudinal axes 90 to accommodate different size articles 55

DETAILED DESCRIPTION

With initial reference to FIG. 1 shown is a front elevation view of the article support apparatus 50 that includes a plurality of beams 85, a support frame 155, a large perimeter structure 175, and a different spacing 180 of the beams 85 apart from one another for different size articles 55 (articles not shown for clarity).

Figure 2:
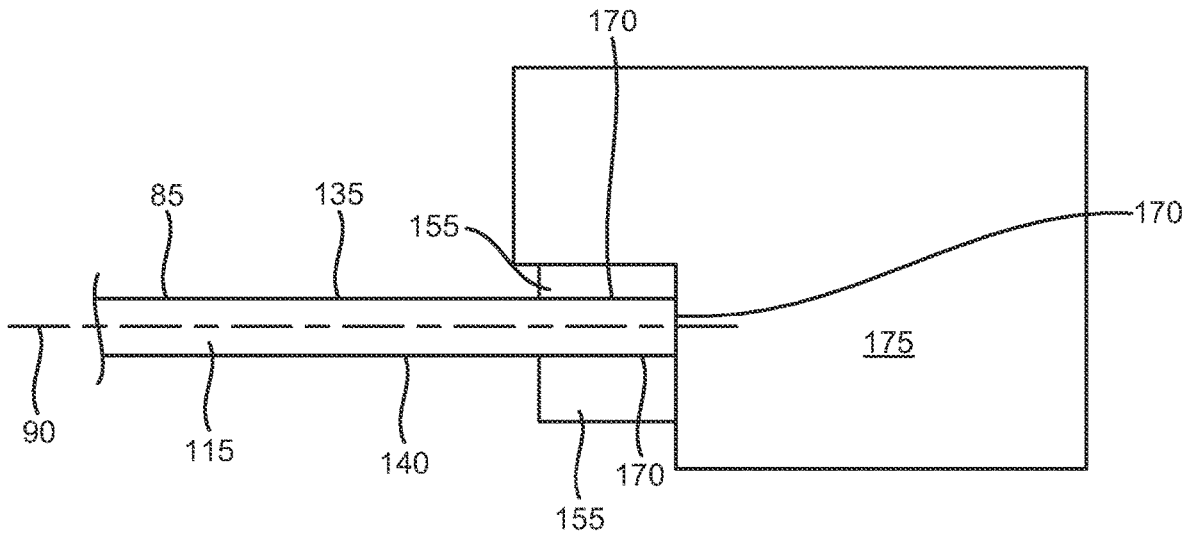
Figure 11:
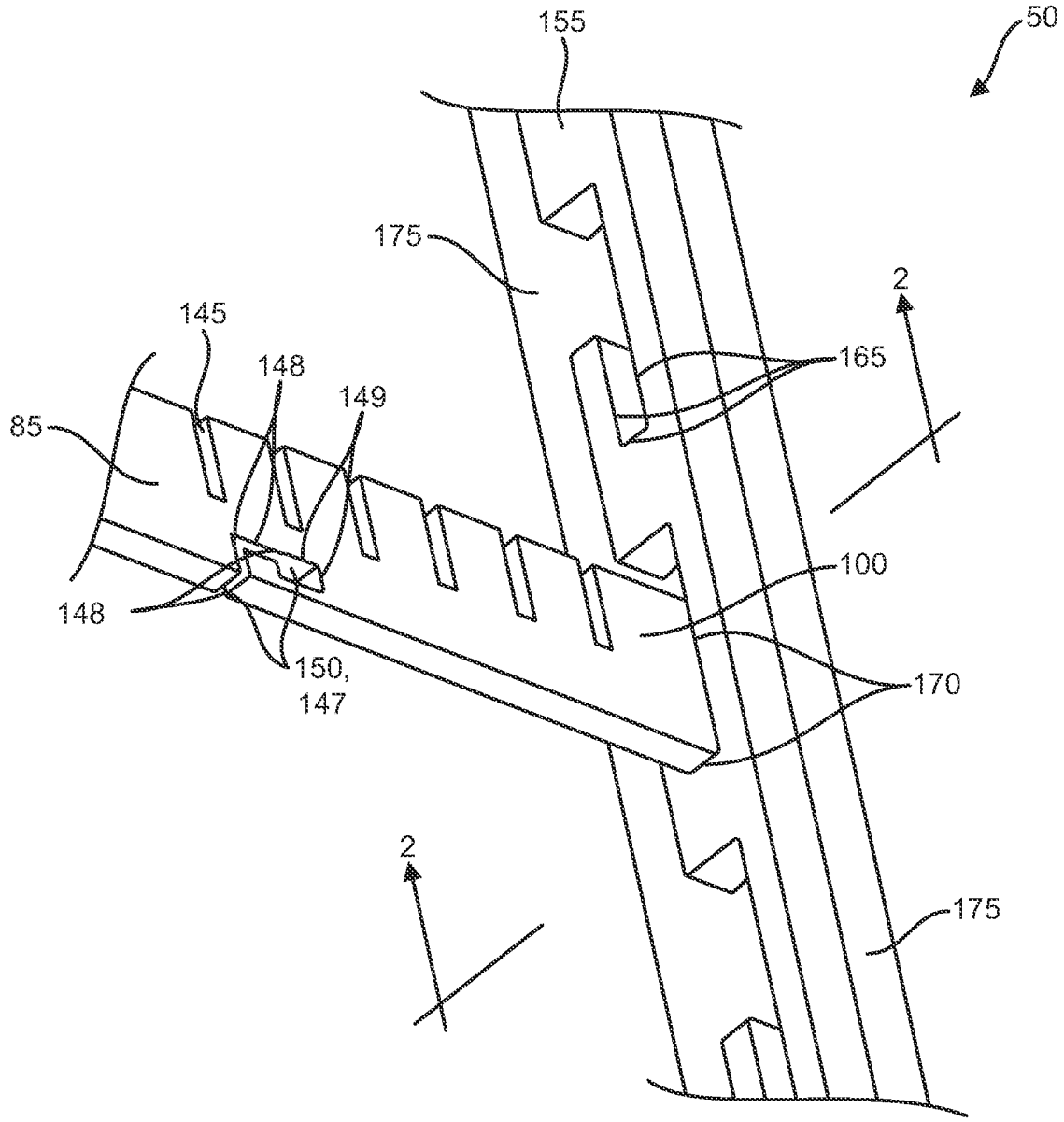
FIG. 11 shows a perspective view of the beam and support frame interface specifically showing the beam resting within the "U" slot, and in this Figure a second end portion of the beam is in the "U" slot with the "U" slot closed side facing frontward, also shown are a larger perimeter structure adjacent to the support frame and both the open straight slot and the "J" hook slot in the beam.

Continuing, FIG. 2 is cross sectional view 2-2 from FIG. 11, wherein FIG. 2 shows the fit-up intersection between the beam 85, the support frame 155, and the larger perimeter structure 175. Next, FIG. 3 shows a front elevation view of the article support apparatus 50 that includes the plurality of beams 85 and the support frame 155.

Figure 3:
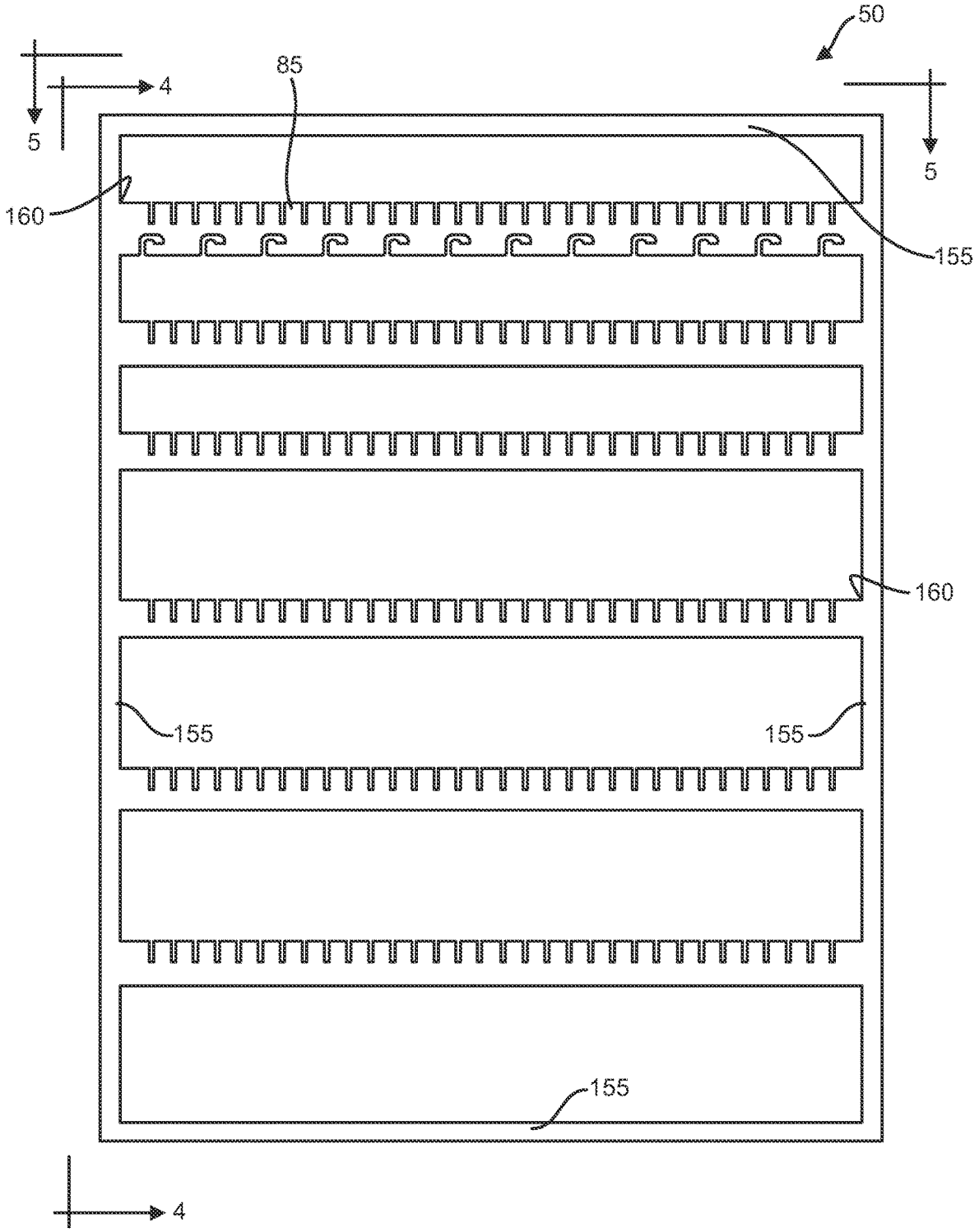
FIG. 3 shows a front elevation view of the article support apparatus that includes the plurality of beams and the support frame.
Figure 4:
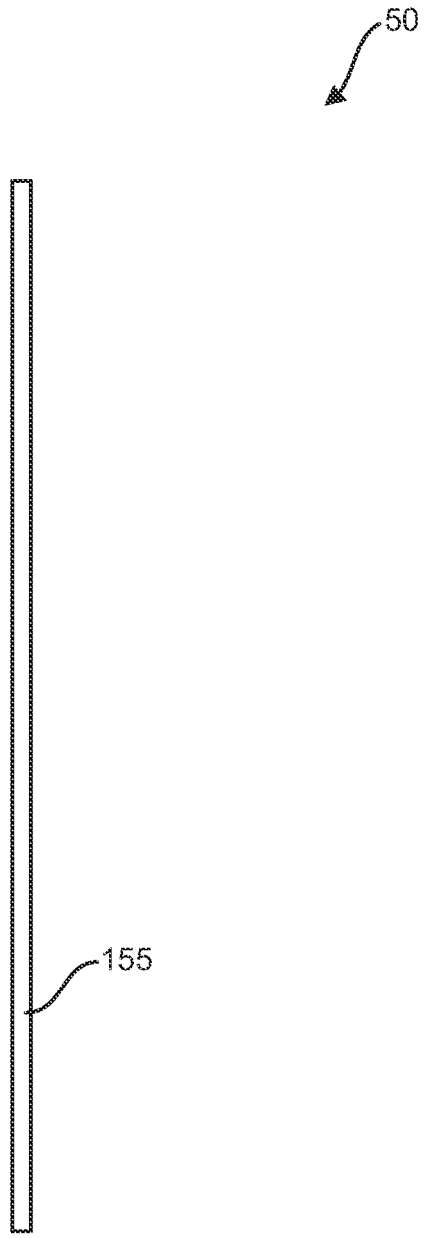
Figure 5:
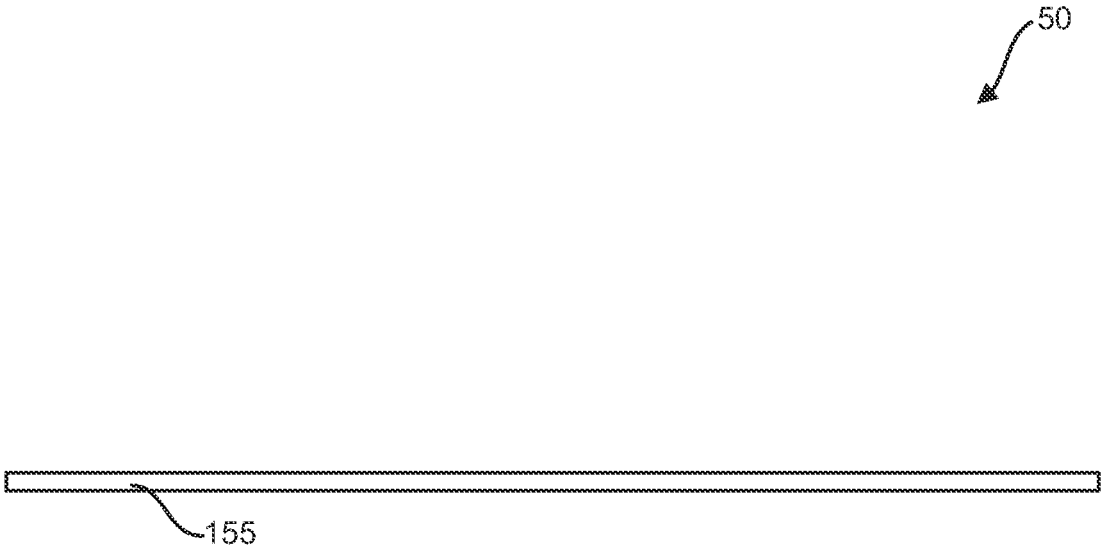
Figure 6:
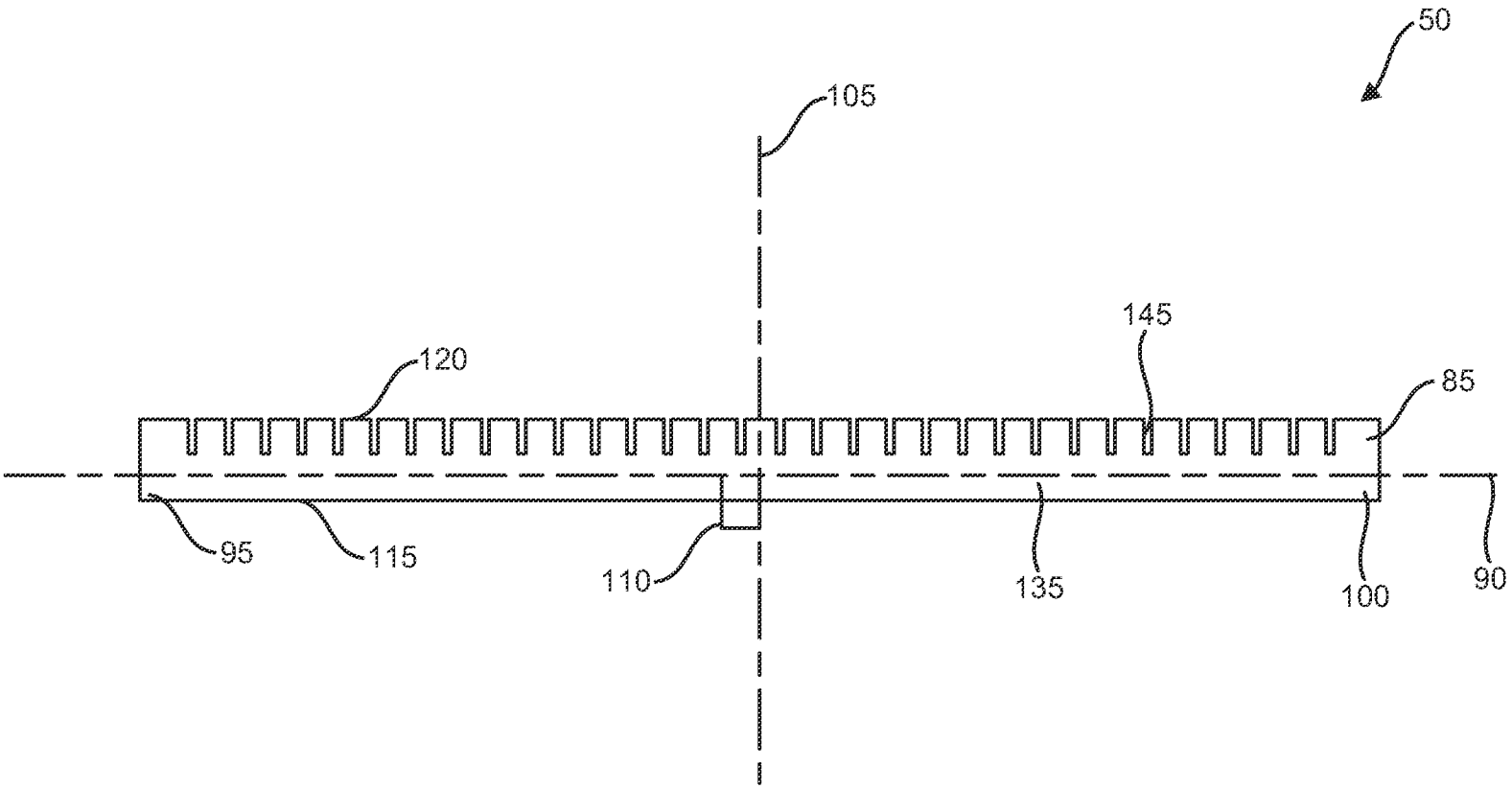
FIG. 6 is a side elevation view of the beam with a plurality of open straight slots showing a longitudinal axis and a vertical axis and their perpendicular position to one another.

Moving onward, FIG. 4 shows view 4-4 from FIG. 3, wherein FIG. 4 shows the side elevation view of the support frame 155 and FIG. 5 shows view 5-5 from FIG. 3, wherein FIG. 5 shows the upper elevation view of the support frame 155, further FIG. 6 is a side elevation view of the beam 85 with a plurality of open straight slots 145 showing a longitudinal axis 90 and a vertical axis 105 and their perpendicular 110 position to one another.

Figure 7:
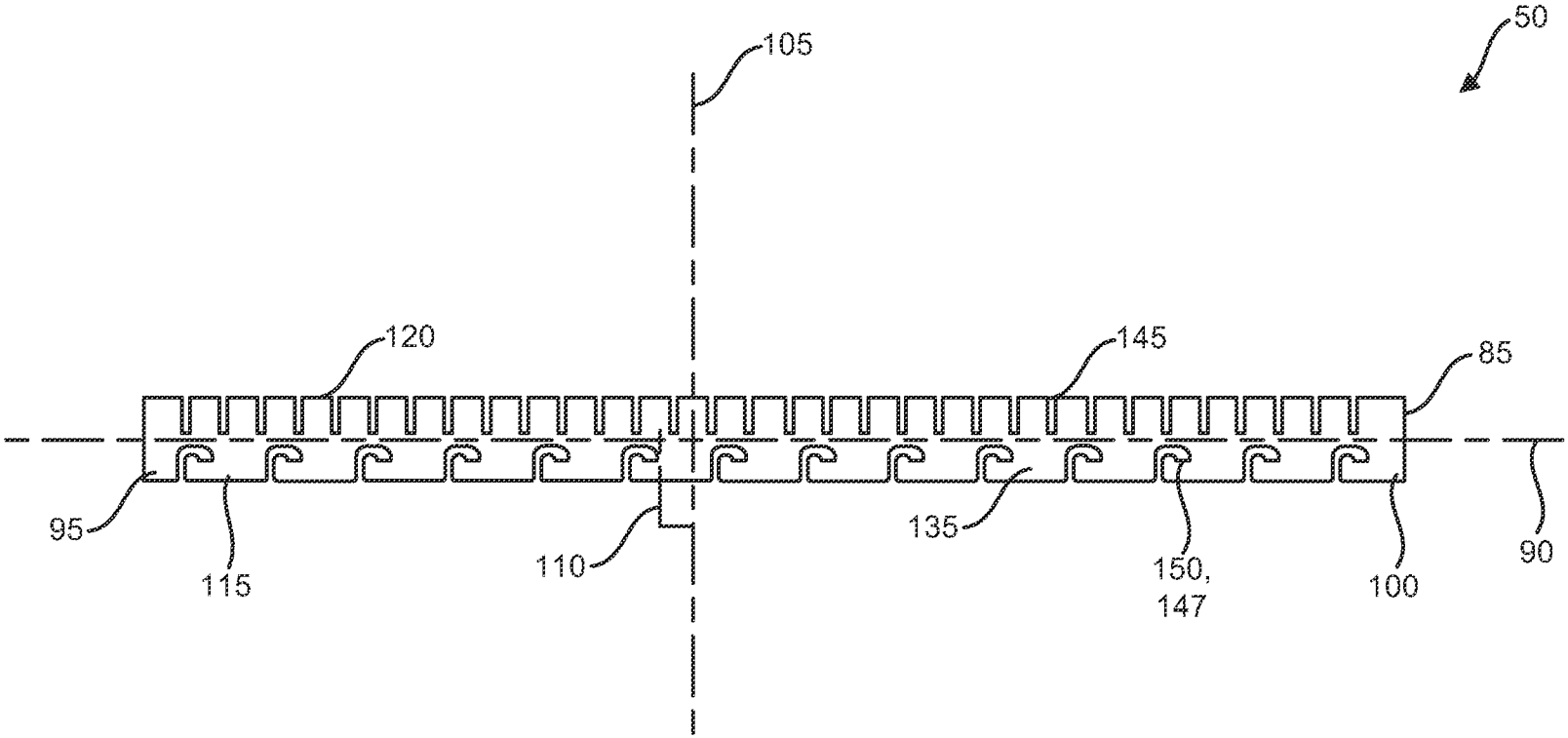
FIG. 7 is a side elevation view of the beam with the plurality of open straight slots and opposing "J" hook slots showing the longitudinal axis and the vertical axis and their perpendicular position to one another.
Figure 8:
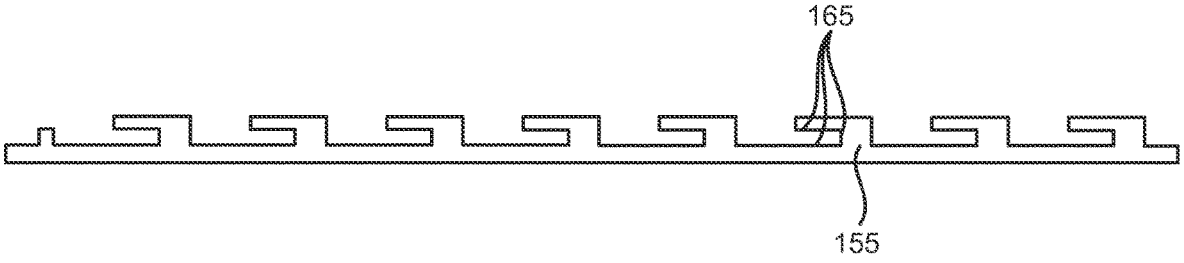
FIG. 8 shows a side elevation view of the support frame specifically detailing a "U" slot of the support frame that holds the beam (beam not shown for clarity)

Next, FIG. 7 is a side elevation view of the beam 85 with the plurality of open straight slots 145 and opposing "J" hook slots 150 showing the longitudinal axis 90 and the vertical axis 105 and their perpendicular position 110 to one another and FIG. 8 shows a side elevation view of the support frame 155 specifically detailing a "U" slot 165 of the support frame 155 that holds the beam 85 (beam not shown for clarity).

Figure 9:
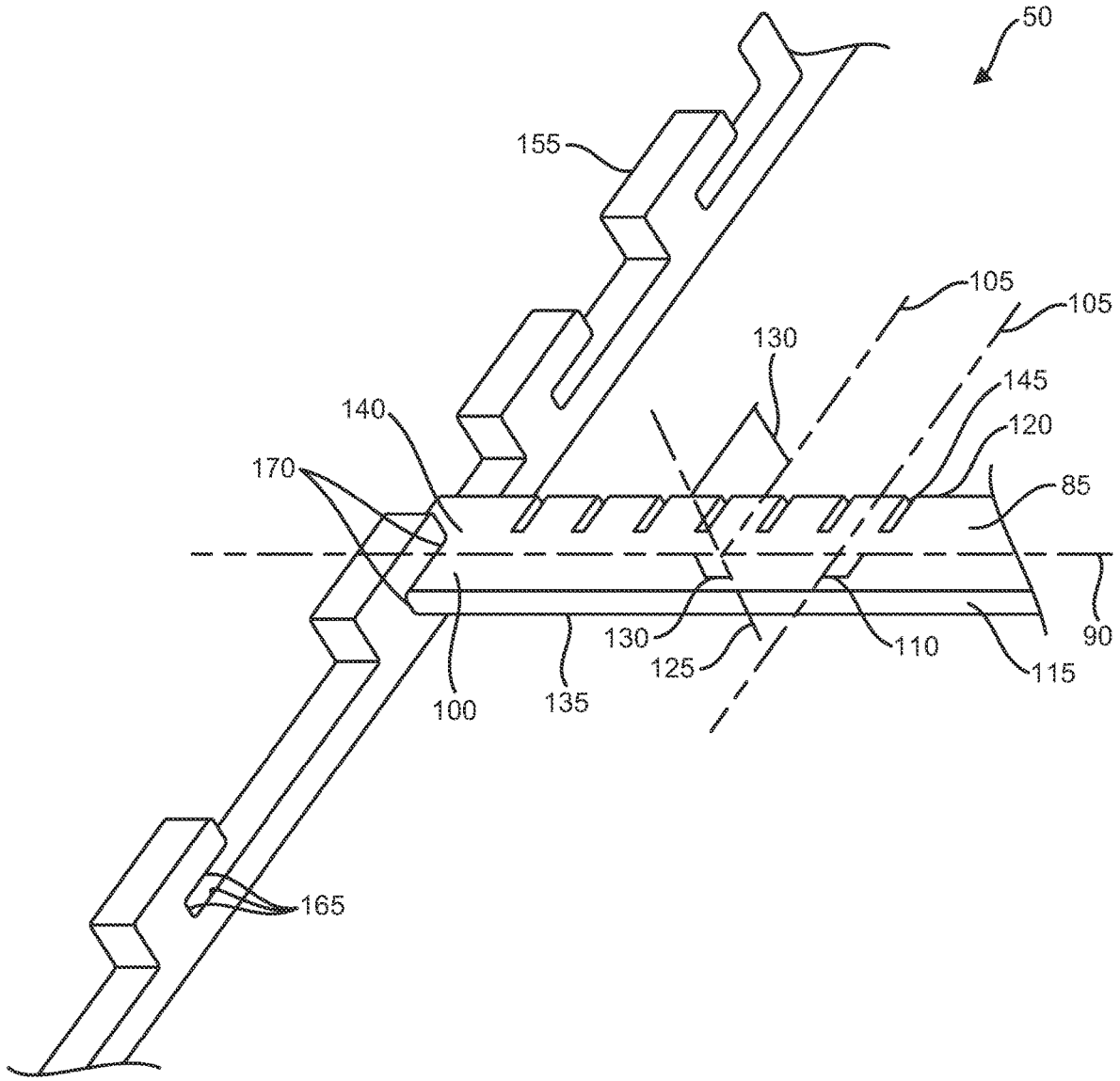
FIG. 9 shows a perspective view of the beam and support frame interface specifically showing the beam resting within the "U" slot, and in this Figure a second end portion of the beam is in the "U" slot with the "U" slot open side facing frontward, also shown in the open straight slot in the beam.

Continuing, FIG. 9 shows a perspective view of the beam 85 and support frame 155 interface specifically showing the beam 85 resting and being disposed 170 within the "U" slot 165, and in this Figure a second end portion 100 of the beam 85 is in the "U" slot 165 with the "U" slot 165 open side facing frontward, also shown is the open straight slot 145 in the beam 85.

Figure 10:
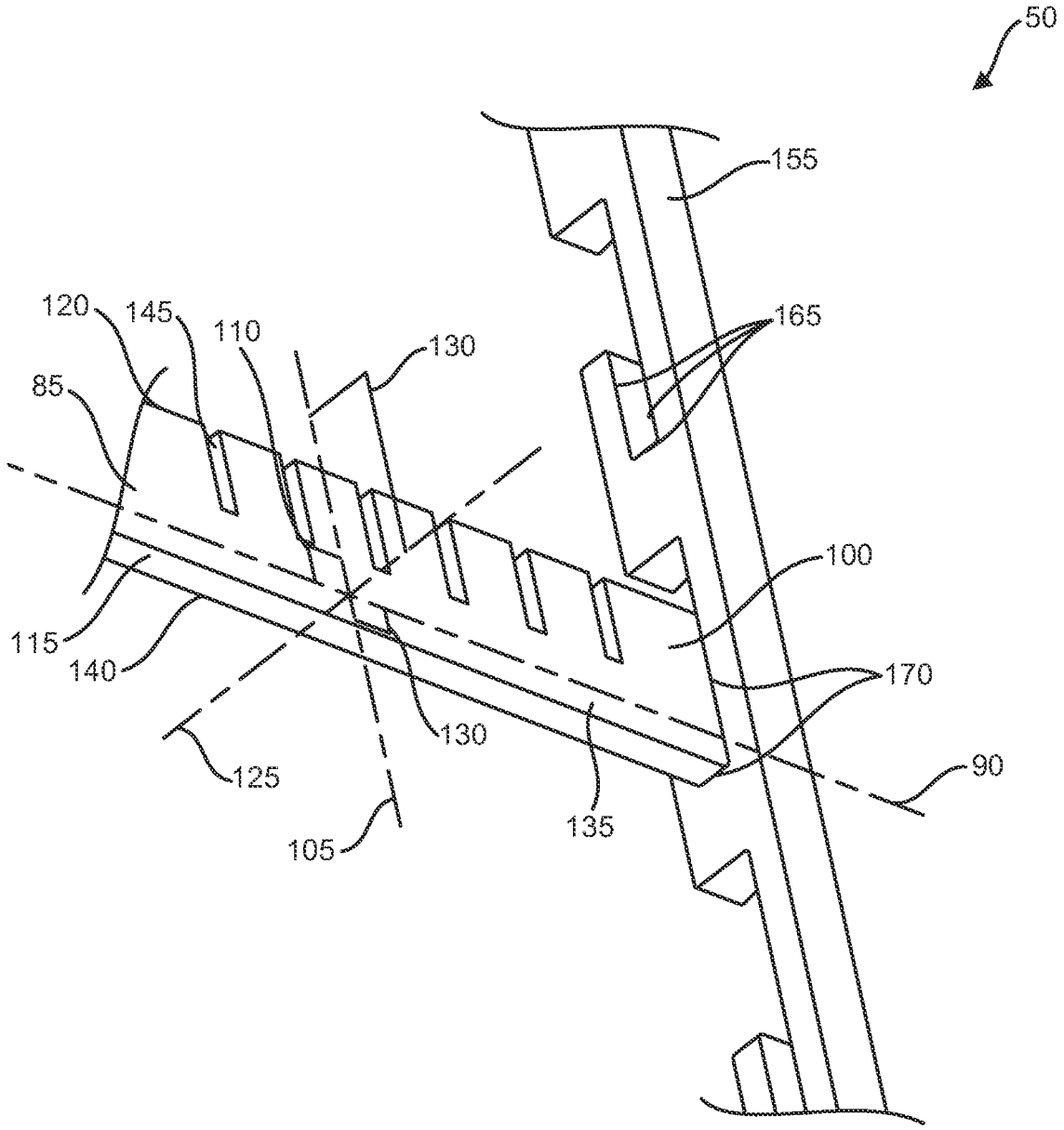
FIG. 10 shows a perspective view of the beam and support frame interface specifically showing the beam resting within the "U" slot, and in this Figure a second end portion of the beam is in the "U" slot with the "U" slot closed side facing frontward, also shown in the open straight slot in the beam.

Moving onward, FIG. 10 shows a perspective view of the beam 85 and support frame 155 interface specifically showing the beam 85 resting and being disposed 170 within the "U" slot 165, and in this Figure a second end portion 100 of the beam 85 is in the "U" slot 165 with the "U" slot 165 closed side facing frontward, also shown is the open straight slot 145 in the beam 85.

Next, FIG. 11 shows a perspective view of the beam 85 and support frame 155 interface specifically showing the beam 85 resting and being disposed 170 within the "U" slot 165, and in this Figure a second end portion 100 of the beam 85 is in the "U" slot 165 with the "U" slot 165 closed side facing frontward, also shown is the larger perimeter structure 175 adjacent to the support frame 155 and both the open straight slot 145 and the "J" hook slot 150 in the beam 85.

Figure 12:
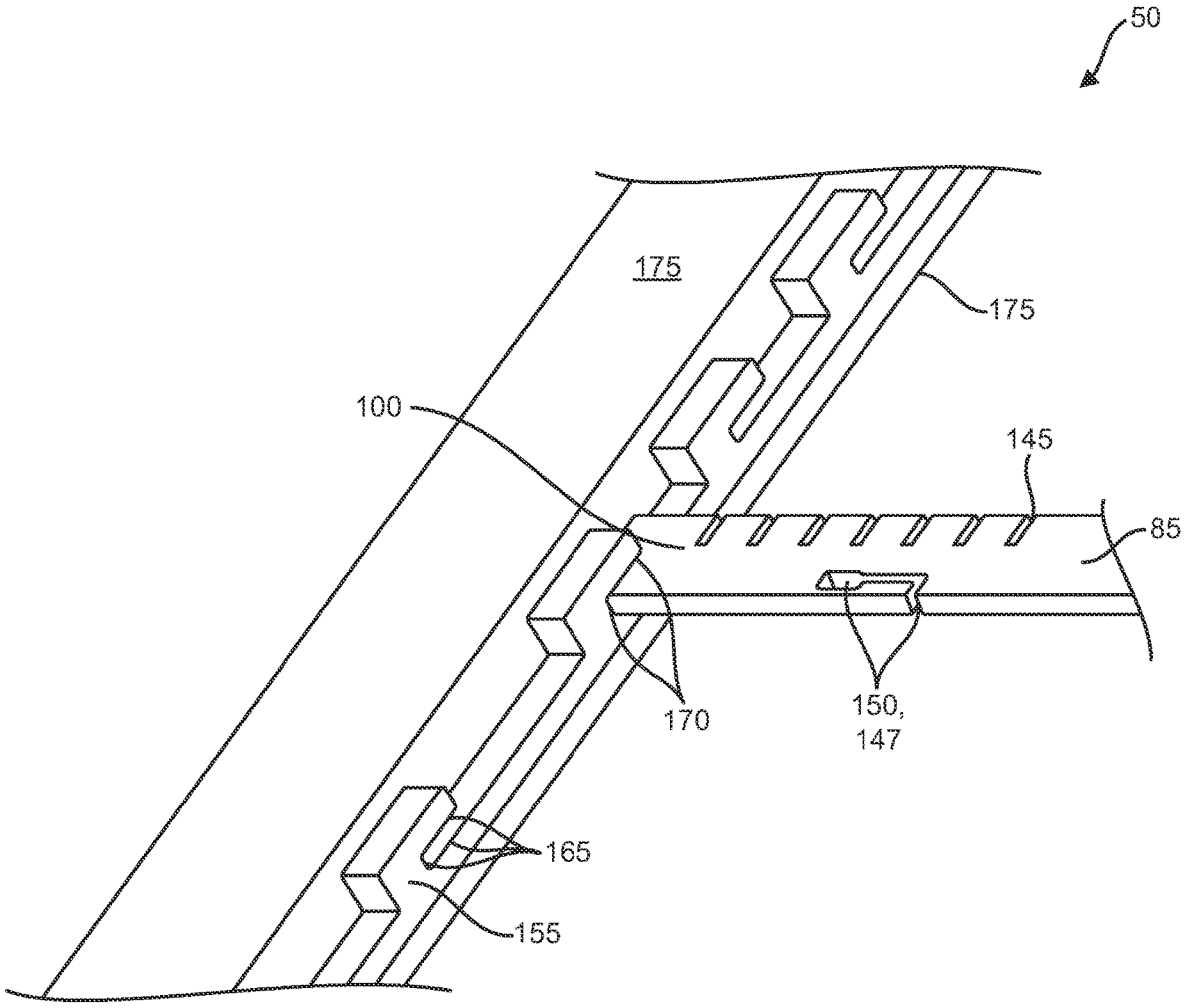
FIG. 12 shows a perspective view of the beam and support frame interface specifically showing the beam resting within the "U" slot, and in this Figure a second end portion of the beam is in the "U" slot with the "U" slot open side facing frontward, also shown are a larger perimeter structure adjacent to the support frame and both the open straight slot and the "J" hook slot in the beam.

Further, FIG. 12 shows a perspective view of the beam 85 and support frame 155 interface specifically showing the beam 85 resting and being disposed 170 within the "U" slot 165, and in this Figure a second end portion 100 of the beam 85 is in the "U" slot 165 with the "U" slot 165 open side facing frontward, also shown is the larger perimeter structure 175 adjacent to the support frame 155 and both the open straight slot 145 and the "J" hook slot 150 in the beam 85.

Figure 13:
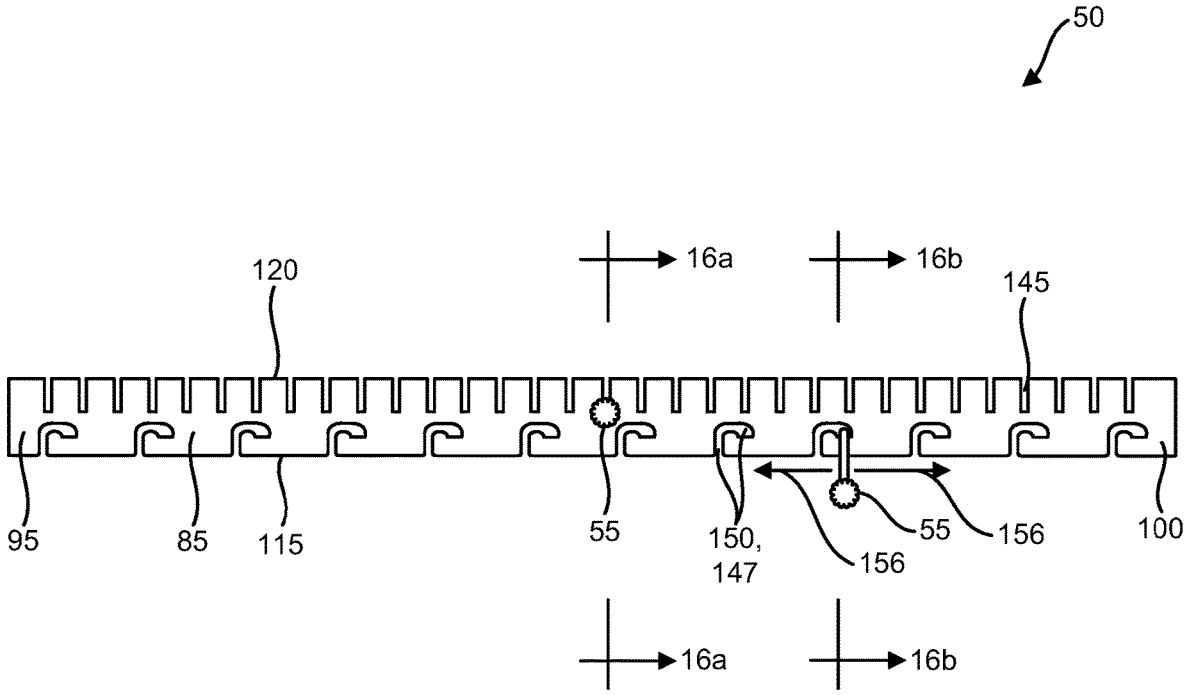
FIG. 13 is a side elevation view of the beam with the plurality of open straight slots and opposing "J" hook slots showing the articles disposed within the open straight slots and opposing "J" hook slots.

Continuing, FIG. 13 is a side elevation view of the beam 85 with the plurality of open straight slots 145 and opposing "J" hook slots 150 showing the articles 55 disposed within the open straight slots 145 and opposing "J" hook slots 150.

Figure 14:
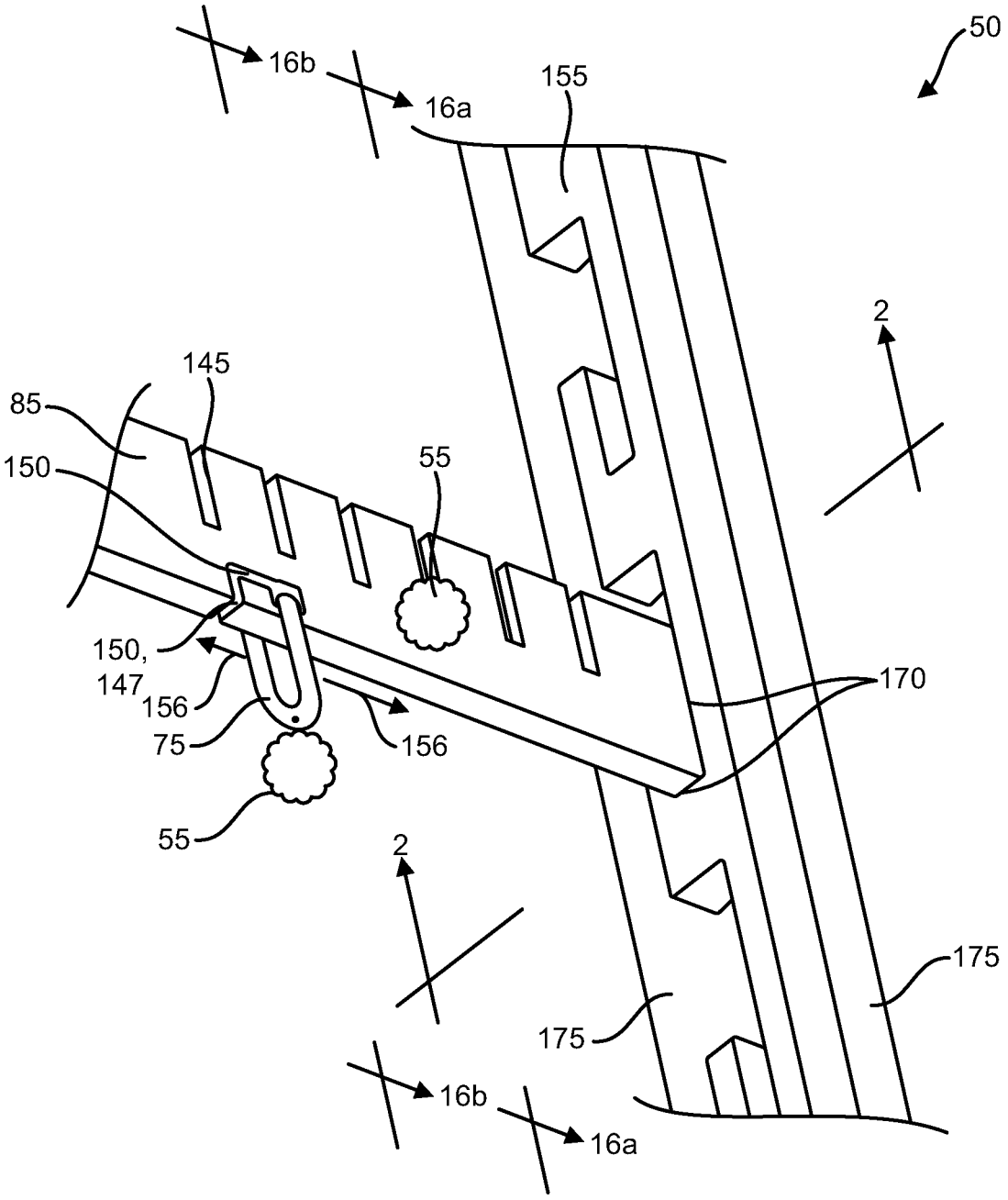
FIG. 14 shows a perspective view of the beam and support frame interface specifically showing the beam resting within the "U" slot, and in this Figure a second end portion of the beam is in the "U" slot with the "U" slot closed side facing frontward, also shown is the larger perimeter structure adjacent to the support frame and both the open straight slot and the "J" hook slot are both shown in the beam, wherein the open straight slot has the article disposed within and the "J" hook slot has the article with the continuous loop section disposed specifically in the "J" hook slot.

Next, FIG. 14 shows a perspective view of the beam 85 and support frame 155 interface specifically showing the beam 85 resting and being disposed 170 within the "U" slot 165, and in this Figure a second end portion 100 of the beam 85 is in the "U" slot 165 with the "U" slot 165 closed side facing frontward, also shown is the larger perimeter structure 175 adjacent to the support frame 155 and both the open straight slot 145 and the "J" hook slot 150 are shown in the beam 85, wherein the open straight slot 145 has the article 55 disposed within and the "J" hook slot 150 has the article 55 with the continuous loop section 75 disposed specifically in the "J" hook slot 150.

Figure 15:
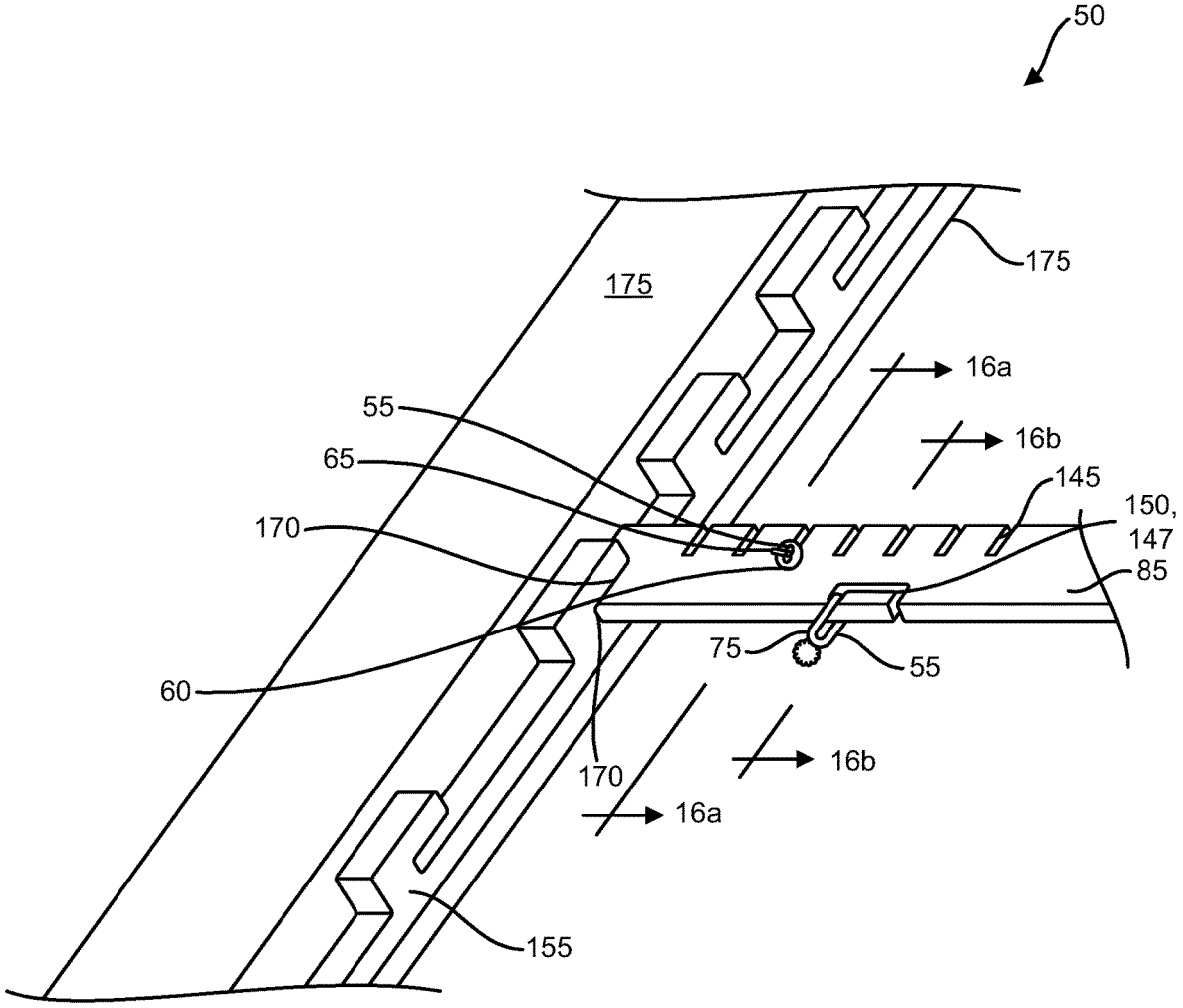
FIG. 15 shows a perspective view of the beam and support frame interface specifically showing the beam resting within the "U" slot, and in this Figure a second end portion of the beam is in the "U" slot with the "U" slot open side facing frontward, also shown is the larger perimeter structure adjacent to the support frame and both the open straight slot and the "J" hook slot are both shown in the beam, wherein the open straight slot has the article with a straight cylinder and a flange disposed within the open straight slot and the "J" hook slot has the article with the continuous loop section disposed specifically in the "J" hook slot.

Moving onward, FIG. 15 shows a perspective view of the beam 85 and support frame 155 interface specifically showing the beam 85 resting and being disposed 170 within the "U" slot 165, and in this Figure a second end portion 100 of the beam 85 is in the "U" slot 165 with the "U" slot 165 open side facing frontward, also shown is the larger perimeter structure 175 adjacent to the support frame 155 and both the open straight slot 145 and the "J" hook slot 150 are both shown in the beam 85, wherein the open straight slot 145 has the article 55 with a straight cylinder 65 and a flange 60 disposed within the open straight slot 145 and the "J" hook slot 150 has the article 55 with the continuous loop section 75 disposed and holding 80 specifically in the "J" hook slot 150.

Figure 16A:
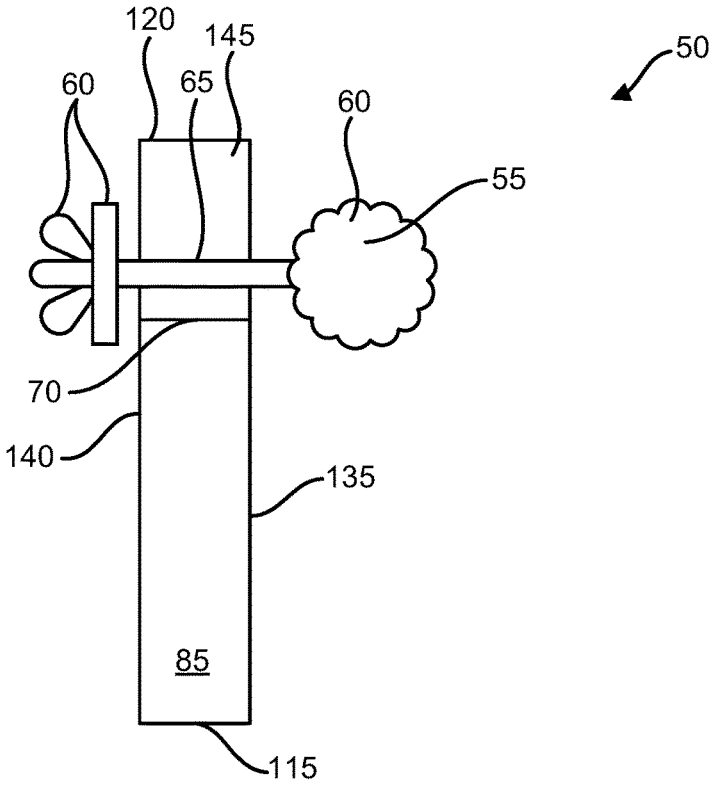
FIG. 16*a* shows cross section view 16*a*-16*a* from FIGS. 13, 14, and 15, wherein FIG. 16*a* more specifically shows the interface between the article and the open straight slot, and more particularly, the open straight slot has the article with a straight cylinder resting in position within and a flange disposed upon each end of the straight cylinder outside both ends of the open straight slot, noting that in particular neither of the flanges need be disassembled from the straight cylinder to either add or remove the article from the open straight slot.

Next, FIG. **16*a* shows cross section view 16*a*-16*a* from FIGS. 13, 14, and 15, wherein FIG. 16*a* more specifically shows the interface between the article 55 and the open straight slot 145, and more particularly, the open straight slot 145 has the article 55 with a straight cylinder 65 resting in position 70 within and a flange 60 disposed upon each end of the straight cylinder 65 outside both ends of the open straight slot 145, noting that in particular neither of the flanges 60 need be disassembled from the straight cylinder 65 to either add or remove the article 55 from the open straight slot 145**.

Figure 16B:
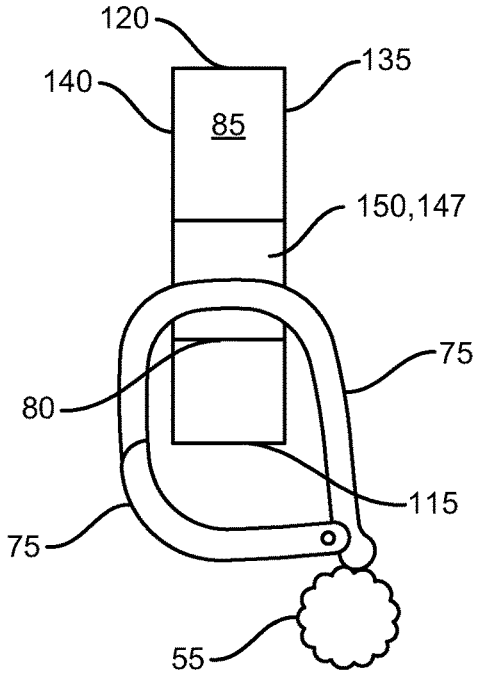
FIG. 16*b* shows cross section view 16*b*-16*b* from FIGS. 13, 14, and 15, wherein FIG. 16*b* more specifically shows the interface between the article and the "J" hook slot has the article with the continuous loop section disposed specifically in the "J" hook slot, further the continuous hoop section also need not be disassembled to either add or remove the article from the "J" hook slot.

Continuing, FIG. **16*b* shows cross section view 16*b*-16*b* from FIGS. 13, 14, and 15, wherein FIG. 16*b* more specifically shows the interface between the article 55 and the "J" hook slot 150 has the article 55 with the continuous loop section 75 disposed specifically in the "J" hook slot 150, further the continuous hoop section 75 also need not be disassembled to either add or remove the article 55 from the "J" hook slot 150**.

Figure 17:
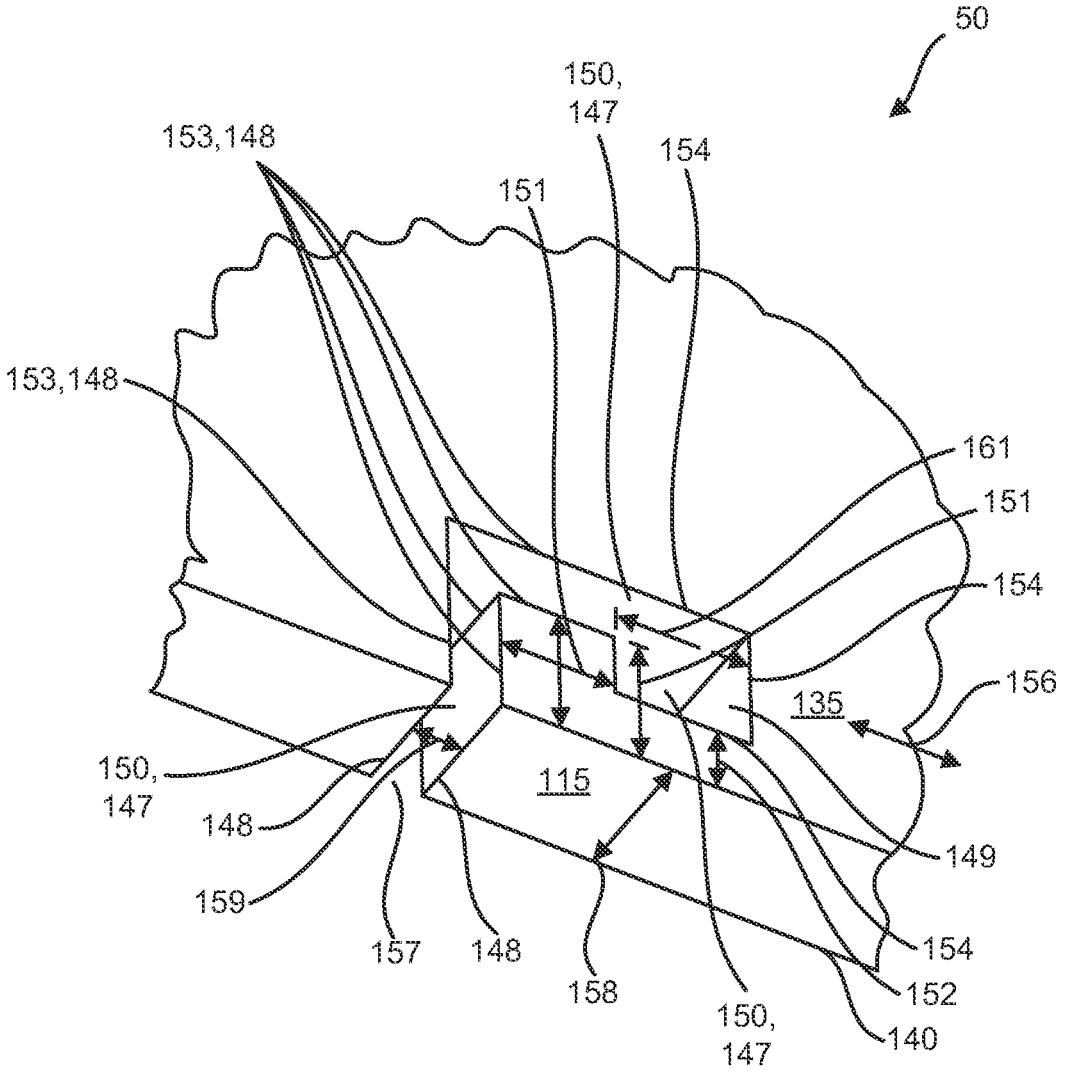

Further, FIG. 17 shows an expanded view of the "J" hook slot 150 that is disposed in the beam 85 as shown from FIG. 11, wherein FIG. 17 shows the open end 157 slot 147, 150 with the neck portion 148 and expanded portion 149 wherein the neck portion 148 of the open end 157 slot 147, 150 can assume a short or long length 151 and be straight, curved or angled in its margin border 153 as long as the article 55, 75 with the continuous loop section 75 can be passed through the neck portion 148, further the expanded portion 149 of the open end 157 slot 147, 150 can assume any shape with termination 154 with the requirement of acting as a repository or holding 80 of the article 55, 75 with the continuous hoop section 75 to not slide out of the neck portion 148, further both the neck portion 148 and the expanded portion 149 are adjacent to the primary margin 115 such that the article 55 continuous hoop section 75 can be disposed about the neck portion 148, the expanded portion 149, and the primary margin 115 to facilitate the continuous hoop section 75 article 55 to be disposed within the open end 157 slot 147 expanded portion 149 and removed from the open end 157 slot 147, without the need for opening the continuous hoop section 75 of the article 55, further for the continuous hoop 75 article 55 to be laterally retained 156 while disposed in the open end 157 slot 147 expanded portion 149, also see FIGS. 13, 14, 15, and 16*b*.

Referring in particular to FIGS. 1 to 17, the present invention is the article support apparatus 50 adapted to support a plurality of different articles 55 in a non-engageable manner (meaning to freely engage and disengage the article 55 from the open straight slot 145 and the open ended 157 "J" hook slot 150 or open ended 157 hook slot 147, without the need to open, take apart, disassemble, or close, latch, or assemble the article 55), the article support apparatus 50 includes the beam 85 having the longitudinal axis 90, the beam 85 having a first end portion 95 and an opposing second end portion 100 with the longitudinal axis 90 spanning therebetween, see in particular FIGS. 1 to 7.

The beam 85 further having the vertical axis 105 that is perpendicular 110 to the longitudinal axis 90, the beam 85 having a primary margin 115 and an opposing secondary margin 120 with the vertical axis 105 spanning therebetween, the beam 85 also having a lateral axis 125 perpendicularly positioned 130 to both the longitudinal 90 and vertical 105 axes, with the beam 85 having a first side 135 and an opposing second side 140 with the lateral axis 125 spanning therebetween, see FIGS. 9 to 17.

The beam 85 further including the open ended 157 straight slot 145 disposed partially into the beam 85 in going from the secondary margin 120 and partially proceeding toward the primary margin 115 being therethrough from the first side 135 to the second side 140, the beam 85 also can have a "J" hook slot 150 disposed partially into the beam 85 in going from the primary margin 115 and partially proceeding toward the secondary margin 120 being therethrough from the first side 135 to the second side 140, again see in particular FIGS. 9 to 17.

Further included in the article support apparatus 50 is the support frame 155 affixed 160 to both the beam 85 first 95 and second 100 end portions, wherein the support frame 155 suspends the beam 85 such that the longitudinal axis 90 is laterally positioned to facilitate operationally the open straight slot 145 holding an article 55 with the flange 60 ended straight cylinder 65 resting 70 in the open straight slot 145 without the need for removing the flange 60 ends from the straight cylinder 65 and the open ended 157 "J" hook slot 150 or open ended 157 slot 147 with neck 148 and expanded 149 portions holding the article 55 with the continuous loop section 75 without the need of opening the article 55 continuous loop section 75, see FIGS. 1 to 7 and FIGS. 9 to 17.

Optionally for the article support apparatus 50, wherein the support frame 155 can be constructed of a plurality of "U" slots 165 that the beam 85 first 95 and second 100 end portions are disposed within to operationally allow for the beam 85 to be removable from the support frame 155, as best shown in FIGS. 8 to 15.

Another option for the article support apparatus 50, wherein the support frame 155 can be further disposed within the larger perimeter structure 175 to accommodate mounting options for the frame 155 selected from the group consisting of wall mounting, table mounting, and door mounting, see in particular FIGS. 1, 2, 11, 12, 14, and 15.

As a further option for the article support apparatus 50, it can further comprise a plurality of beams 85, wherein the beam 85 longitudinal axes 90 are at a different spacing 180 to one another to accommodate different size articles 55, see in particular FIG. 1, and FIGS. 13 to 17.

CONCLUSION

Accordingly, the present invention of an article support apparatus has been described with some degree of particularity directed to the embodiments of the present invention. It should be appreciated, though; that the present invention is defined by the following claims construed in light of the prior art so modifications of the changes may be made to the exemplary embodiments of the present invention without departing from the inventive concepts contained therein.

The invention claimed is:

1. An article support apparatus adapted to support a plurality of different articles in a non-engageable manner, said article support apparatus comprising:

(a) a beam having a longitudinal axis, said beam having a first end portion and an opposing second end portion with said longitudinal axis spanning therebetween, said beam further having a vertical axis that is perpendicular to said longitudinal axis, said beam having a primary margin and an opposing secondary margin with said vertical axis spanning therebetween, said beam also having a lateral axis perpendicularly positioned to both said longitudinal and vertical axes, with said beam having a first side and an opposing second side with said lateral axis spanning therebetween, said beam further including an open straight slot disposed partially into said beam in going from said secondary margin and partially proceeding toward said primary margin being therethrough from said first side to said second side, said beam also has a neck portion and expanded portion of an open ended slot disposed partially into said beam in going from said primary margin and partially proceeding toward said secondary margin being therethrough from said first side to said second side, wherein said neck portion and expanded portion open ended slot is sized and configured such that said expanded open ended slot has a termination portion that has an adjacent distance that is closer to said primary margin than a margin border of said neck portion to said primary margin, to operationally laterally retain the continuous hoop section article with said open ended slot, wherein further said neck portion and expanded portion open ended slot is further sized and configured such that a width of said slot open end is less than or equal to a length of said expanded portion, to operationally facilitate the continuous hoop section article being laterally retained in said open ended slot, further a length portion of said neck portion is greater than said width of said slot open end that transitions into said expanded portion wherein a step is formed between said adjacent distance and said length portion of said neck portion to form a squared off expanded portion, with said step parallel to a portion of said margin border, this all being in conjunction with a "L" shaped perpendicularly oriented pair of parallel straight slots in communication with one another as defined by said width of said slot and a margin border of said neck portion, to operationally benefit via said step to retain the article within said expanded portion; and (b) a support frame affixed to both said beam first and second end portions, wherein said support frame suspends said beam such that said longitudinal axis is laterally positioned to facilitate operationally said open straight slot holding an article with a flange ended straight cylinder resting in said open straight slot without the need for removing the flange ends and said neck portion and expanded open ended slot holding an article with a continuous loop section without the need of opening the article continuous loop section.

2. The article support apparatus according to claim 1 wherein said neck portion and expanded open ended slot is sized and configured into a "J" hook slot.

3. The article support apparatus according to claim 1 wherein said support frame is constructed of a plurality of "U" slots that said beam first and second end portions are disposed within to operationally allow for said beam to be removable from said frame.

4. The article support apparatus according to claim 1 wherein said support frame is further disposed within a larger perimeter structure to accommodate mounting options for the frame selected from the group consisting of wall mounting, table mounting, and door mounting.

5. The article support apparatus according to claim 1 further comprising a plurality of beams, wherein said beam longitudinal axes are at a different spacing to one another to accommodate different size articles.

6. An article support apparatus adapted to support a plurality of different articles in a non-engageable manner, said article support apparatus comprising:

(a) a beam having a longitudinal axis, said beam having a first end portion and an opposing second end portion with said longitudinal axis spanning therebetween, said beam further having a vertical axis that is perpendicular to said longitudinal axis, said beam having a primary margin and an opposing secondary margin with said vertical axis spanning therebetween, said beam also having a lateral axis perpendicularly positioned to both said longitudinal and vertical axes, with said beam having a first side and an opposing second side with said lateral axis spanning therebetween, said beam further including an open straight slot disposed partially into said beam in going from said secondary margin and partially proceeding toward said primary margin being therethrough from said first side to said second side, said beam also has a neck portion and expanded open ended slot disposed partially into said beam in going from said primary margin and partially proceeding toward said secondary margin being therethrough from said first side to said second side, wherein said neck portion and expanded portion open ended slot is sized and configured such that said expanded open ended slot has a termination portion that has an adjacent distance that is closer to said primary margin than a margin border of said neck portion to said primary margin, to operationally laterally retain the continuous hoop section article with said open ended slot, wherein further said neck portion and expanded portion open ended slot is further sized and configured such that a width of said slot open end is less than or equal to a length of said expanded portion, to operationally facilitate the continuous hoop section article being laterally retained in said open ended slot, further a length portion of said neck portion is greater than said width of said slot open end that transitions into said expanded portion wherein a step is formed between said adjacent distance and said length portion of said neck portion to form a squared off expanded portion with said step parallel to a portion of said margin border, this all being in conjunction with a "L" shaped perpendicularly oriented pair of parallel straight slots in communication with one another as defined by said width of said slot and a margin border of said neck portion, to operationally benefit via said step to retain the article within said expanded portion.

7. The article support apparatus according to claim 6 wherein said neck and expanded slot is sized and configured into a "J" hook slot.

8. An article support apparatus adapted to support a plurality of different articles in a non-engageable manner, said article support apparatus comprising:

(a) a beam having a longitudinal axis, said beam having a first end portion and an opposing second end portion with said longitudinal axis spanning therebetween, said beam further having a vertical axis that is perpendicular to said longitudinal axis, said beam having a primary margin and an opposing secondary margin with said vertical axis spanning therebetween, said beam also having a lateral axis perpendicularly positioned to both said longitudinal and vertical axes, with said beam having a first side and an opposing second side with said lateral axis spanning therebetween, said beam further including an open straight slot disposed partially into said beam in going from said secondary margin and partially proceeding toward said primary margin being therethrough from said first side to said second side, said beam also has a neck portion and expanded open ended slot disposed partially into said beam in going from said primary margin and partially proceeding toward said secondary margin being therethrough from said first side to said second side, wherein said neck portion and expanded portion open ended slot is sized and configured such that said expanded open ended slot has a termination portion that has an adjacent distance that is closer to said primary margin than a margin border of said neck portion to said primary margin, to operationally laterally retain the continuous hoop section article with said open ended slot, wherein further said neck portion and expanded portion open ended slot is further sized and configured such that a width of said slot open end is less than or equal to a length of said expanded portion, to operationally facilitate the continuous hoop section article being laterally retained in said open ended slot, further a length portion of said neck portion is greater than said width of said slot open end that transitions into said expanded portion wherein a step is formed between said adjacent distance and said length portion of said neck portion to form a squared off expanded portion with said step parallel to a portion of said margin border, this all being in conjunction with a "L" shaped perpendicularly oriented pair of parallel straight slots in communication with one another as defined by said width of said slot and a margin border of said neck portion, to operationally benefit via said step to retain the article within said expanded portion;

(b) a support frame affixed to both said beam first and second end portions, wherein said support frame suspends said beam such that said longitudinal axis is laterally positioned to facilitate operationally said open straight slot holding an article with a flange ended straight cylinder resting in said open straight slot without the need for removing the flange ends and said necked and expanded slot holding an article with a continuous loop section without the need of opening the article continuous loop section; and (c) a larger perimeter structure that said support frame is disposed within to accommodate mounting options for the said support frame selected from the group consisting of wall mounting, table mounting, and door mounting.

9. The article support apparatus according to claim 8 wherein said neck and expanded slot is sized and configured into a "J" hook slot.

10. The article support apparatus according to claim 8 wherein said support frame is constructed of a plurality of "U" slots that said beam first and second end portions are disposed within to operationally allow for said beam to be removable from said frame.

11. The article support apparatus according to claim 8 further comprising a plurality of beams, wherein said beam longitudinal axes are at a different spacing to one another to accommodate different size articles.

* * * * *